US012384611B2

(12) United States Patent
Zhu et al.

(10) Patent No.: US 12,384,611 B2
(45) Date of Patent: Aug. 12, 2025

(54) MATTRESS PACKAGE AND METHOD FOR PACKAGING A MATTRESS

(71) Applicant: IKEA Supply AG, Pratteln (CH)

(72) Inventors: Wenjie Zhu, Shanghai (CN); Xiaoqi Jiang, Shanghai (CN); Fangzhi Zhang, Shanghai (CN)

(73) Assignee: INTER IKEA SYSTEMS B.V. (NL)

( * ) Notice: Subject to any disclaimer, the term of this patent is extended or adjusted under 35 U.S.C. 154(b) by 135 days.

(21) Appl. No.: 18/285,237

(22) PCT Filed: Apr. 1, 2022

(86) PCT No.: PCT/EP2022/058751
§ 371 (c)(1),
(2) Date: Sep. 29, 2023

(87) PCT Pub. No.: WO2022/207904
PCT Pub. Date: Oct. 6, 2022

(65) Prior Publication Data

US 2024/0182226 A1 Jun. 6, 2024

(30) Foreign Application Priority Data

Apr. 2, 2021 (CN) ..... 202110361629.9

(51) Int. Cl.

| | |
|---|---|
| ***B65D 71/00*** | (2006.01) |
| ***A47C 27/00*** | (2006.01) |
| ***B65B 3/04*** | (2006.01) |
| ***B65B 5/10*** | (2006.01) |
| ***B65B 63/04*** | (2006.01) |

(Continued)

(52) U.S. Cl.
CPC ..... *B65D 77/02* (2013.01); *A47C 27/001* (2013.01); *B65B 5/10* (2013.01); *B65B 63/04* (2013.01); *B65D 85/07* (2018.01); *B65D 2577/043* (2013.01); *B65D 2585/647* (2013.01)

(58) Field of Classification Search
CPC ..... B65D 77/02; B65D 85/04; B65D 85/07; B65B 5/00; B65B 63/00; A47C 27/001; A47C 27/15; A47C 31/105
USPC ..... 206/225, 391–394; 53/443, 467, 473; 5/652.1, 690, 724, 737, 738, 740
See application file for complete search history.

(56) References Cited

U.S. PATENT DOCUMENTS 1,579,074 A * 3/1926 Burton ..... A47C 27/001 5/690
4,369,929 A * 1/1983 Cayer ..... B65H 35/0006 242/594.6

(Continued)

FOREIGN PATENT DOCUMENTS

CN 105852516 A 8/2016
DE 20314109 U1 12/2003

OTHER PUBLICATIONS

English abstract for DE-20314109.
English abstract for CN-105852516A.

*Primary Examiner* — Luan K Bui
(74) *Attorney, Agent, or Firm* — Fishman Stewart PLLC

(57) ABSTRACT

A mattress package may include a plurality of core rolls, a covering roll, and a box containing the plurality of core rolls and the covering roll. The plurality of core rolls may be defined by a plurality of rolled up core segments. The covering roll may be defined by a rolled up cover material configured to cover a mattress core formed via assembling the plurality of core segments.

20 Claims, 9 Drawing Sheets

(51) Int. Cl.
*B65D 77/02* (2006.01)
*B65D 85/07* (2017.01)

(56) References Cited

U.S. PATENT DOCUMENTS

| | | | | | |
|---|---|---|---|---|---|
| 4,471,873 | A * | 9/1984 | Thomas | G09F 21/04 | 248/205.5 |
| 5,927,494 | A * | 7/1999 | Fowler | B65D 5/02 | 206/391 |
| 8,181,296 | B2 * | 5/2012 | Rawls-Meehan | G06Q 10/101 | 5/722 |
| 8,370,979 | B2 * | 2/2013 | Fukano | A47C 27/064 | 5/716 |
| 9,131,782 | B1 | 9/2015 | Baker | | |
| 2016/0316928 | A1 | 11/2016 | Zhang | | |
| 2017/0119169 | A1 * | 5/2017 | Krim | A47C 21/046 | |
| 2023/0088072 | A1 * | 3/2023 | Stojanovic | A47C 27/001 | 5/665 |

* cited by examiner

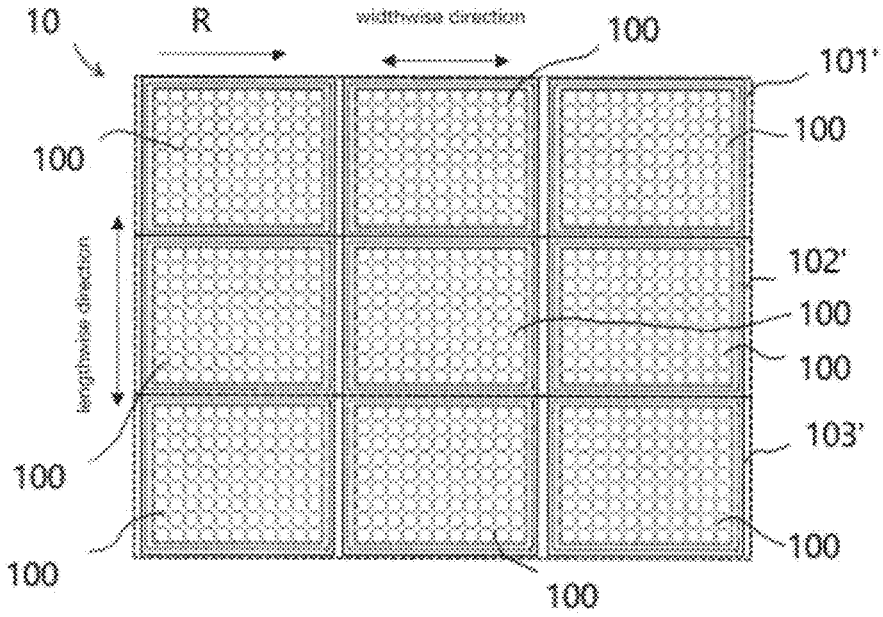
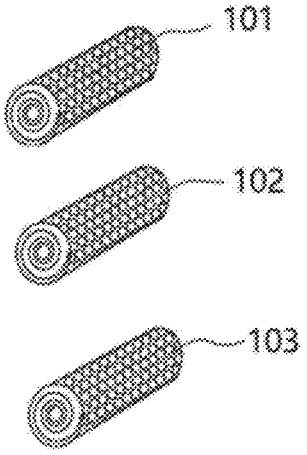
FIG. 6A
FIG.6B

MATTRESS PACKAGE AND METHOD FOR PACKAGING A MATTRESS

CROSS-REFERENCE TO RELATED APPLICATIONS

This application claims priority to International Patent Application No. PCT/EP2022/058751, filed on Apr. 1, 2022, and Chinese Patent Application No. CN 202110361629.9, filed on Apr. 2, 2021, the contents of both of which are hereby incorporated by reference in their entirety.

TECHNICAL FIELD

This present invention relates to a mattress package, particularly to a mattress package construction adapted to allow for ease of transportation and storage between manufacture and use. The present invention also relates to a method for packaging a mattress.

BACKGROUND

Most of the existing mattresses, especially the spring mattresses, are one-piece monolithic components. Their overall volume is large, which therefore requires a large space for handling or storage, and high cost for storage and transportation. The construction of the existing spring mattresses has heretofore presented a barrier to packaging in a form convenient for delivery. In addition, after the user receives the mattresses, it is difficult to carry them, due to their large volumes, and especially when carrying them in a limited space, for example, in a room, they may easily rub and touch the walls of the room, causing damage and scratch. In addition to large volume, the existing mattress is also too heavy to be carried by the user himself. Users can only carry it or make bed with the help of others, causing great inconveniences in daily use.

Although currently there are some mattresses assembled from multiple mattress core blocks, it is still difficult to save the space occupied and the transportation costs for the packaging and handling of the various parts of one mattress before assembling. In addition, packaging costs are high, and packaging integrity is difficult to guarantee.

Therefore, the present invention aims to overcome one or more of the above-mentioned problems in the prior art.

SUMMARY

In order to solve the above-mentioned problems in the prior art, the present invention proposes a mattress package, which can greatly improve packaging efficiency, reduce packaging costs and transportation costs, and allows users to handle, assemble and use flexibly, with improved convenience and comfort in use.

According to one aspect of the present invention, a mattress package is provided, comprising:

- a plurality of core rolls formed by rolling up core segments, wherein a mattress core is formed by assembling these core segments;
- a covering roll formed by rolling up a cover material configured for covering the mattress core; and
- a box containing the plurality of core rolls and the covering roll.

Preferably, the plurality of core rolls and the covering roll are placed, or at least being arrangeable, in parallel in the box, and the core rolls are substantially the same in length and optionally substantially the same in width measured at an unrolled state. In this configuration, the mattress core can be packed in a box as small as possible and the cost for delivery can be reduced to the minimum. Also, the box can be avoided from creating any large empty space therein which is prone to collapse when receiving heavy collision during transportation. Furthermore, the consumers can easily assemble unrolled core segments by themselves without the need of distinguishing them from each other.

In an embodiment, the sum of the lengths of the core rolls is equal to a length or width of the mattress core.

In an embodiment, the length of the covering roll is substantially the same as the length of each core roll. In this way, the space in the box can be used efficiently, reducing the risk of collapse caused by large empty space in the box.

In an embodiment, the mattress package comprises two to six core rolls, preferably, three core rolls.

In an embodiment, the box is a cardboard box, for example, a corrugated fiberboard box.

In an embodiment, the core segments each comprise one or more core subsegments arranged in a row along its unrolling direction.

In an embodiment, the core subsegments are pieces in the form of spring cores, such as pocket spring cores, or latex cores, or sponge cores.

In an embodiment, each core subsegment is selected from a first base module and a second base module, the first and second base modules being the same in length but different in width ranging from 50~100 cm, preferably 60 cm or 90 cm. By doing so, the production efficiency can be greatly improved because mattress core of many sizes can be obtained with these base modules which requires no redesign or modification of the equipment for these base modules.

Preferably, the core segments each comprise at most three base modules.

Preferably, the core segments each comprise one first base module and one second base module. Preferably, the base modules are arranged in a same or different sequence among core rolls; and preferably the base modules in the core segment(s) to be assembled as a middle section of the mattress core are arranged in a sequence different from those in the core segments to be assembled as end sections of the mattress core.

In an embodiment, the cover material comprises a mattress cover for wrapping around the mattress core and a functional pad for covering the mattress core.

Preferably, the mattress cover is provided with elastic strips for holding the mattress core at its corners.

According to another aspect of the present invention, a method for packaging a mattress is provided, wherein the mattress comprises: a plurality of core segments arranged side-by-side in one direction of the lengthwise and widthwise directions of the mattress and preferably being substantially the same in length and optionally substantially the same in width, wherein a mattress core is formed by assembling the core segments; and a cover material provided for covering the mattress core, wherein the method comprises following steps:

- rolling up the core segments respectively along the other direction of the lengthwise and widthwise directions of the mattress so as to form core rolls;
- folding and rolling up the cover material into a covering roll, preferably with the cover material being folded into a substantially same size and shape as one core segment and then rolled up along a same direction as the rolling direction of the core segments; and putting the core rolls and the covering roll into a box, preferably with the core rolls and the covering roll being placed in parallel.

Preferably, the method comprises a step of compressing each core segment in its thickness direction before rolling up.

In an embodiment, the core segments each comprise one or more core subsegments. Preferably, each core subsegment is selected from a first base module and a second base module, the first and second base modules being the same in length but different in width ranging from 50~100 cm, preferably 60 cm or 90 cm. And the method comprises, before the step of compressing, a step of packing the one or more core subsegments in each core segment into a bag, with the core subsegments being arranged in a row along the rolling direction of the core segments.

According to the mattress package of the present invention, the mattress, especially the spring mattress, can be transported at greatly reduced cost in transportation, and is no longer subject to the limitations of expensive and inconvenient packaging and transportation and a lack of diversity in use, and the popularity of the modular mattress can be improved. In addition, the mattress thus obtained, i.e. of a 'mattress in a box' product type, is convenient for consumers to purchase, transport or assemble by themselves, and consumers can splice the mattress segments or change or adjust the assembling pattern according to their own needs.

BRIEF DESCRIPTION OF THE DRAWINGS

Further disclosure, objects, advantages and aspects of the present invention may be better understood by those skilled in the relevant art by reference to the following description of preferred embodiments taken in conjunction with the accompanying drawings, which are given by way of illustration only and thus not limitative of the present invention, and in which:

FIGS. 6A and 6B are diagrammatic illustrations of a mattress core for a double/king/queen bed and three core rolls formed by rolling up the core segments along the widthwise direction of the mattress core;

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

In the following description, where directionally related terms are used such as 'top', 'upper', 'bottom', 'lower', 'above', 'below', 'sides' and the like, these are understood to be with reference to a mattress that is configured and positioned for use, such as lying flat on a bed base, unless the context requires otherwise. Terms referring to the 'length/lengthwise' and 'width/widthwise' of a mattress or its components should be understood to be with reference to two main dimensions for defining an outline of a mattress whereby the lengthwise dimension is equal to or bigger than the widthwise dimension for a mattress.

Hereinbelow, the terms 'first', 'second', etc. are only used to distinguish each other, rather than to indicate the degree of importance and order, and the premise of mutual existence, etc.

Figure 1A:
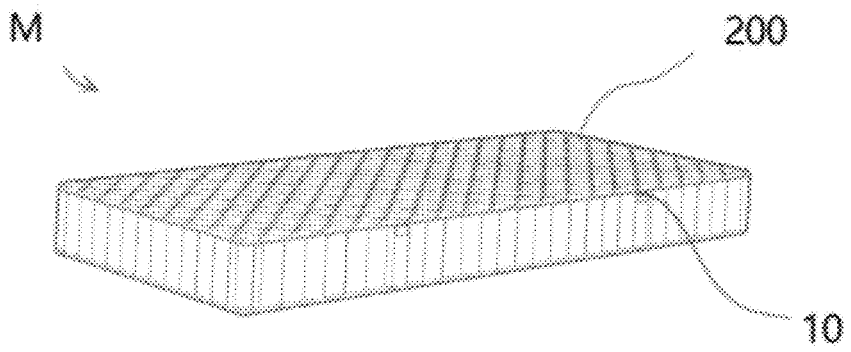
FIG. 1A shows a perspective view of a mattress to be packed according to the packaging method of the present invention.
Figure 1B:
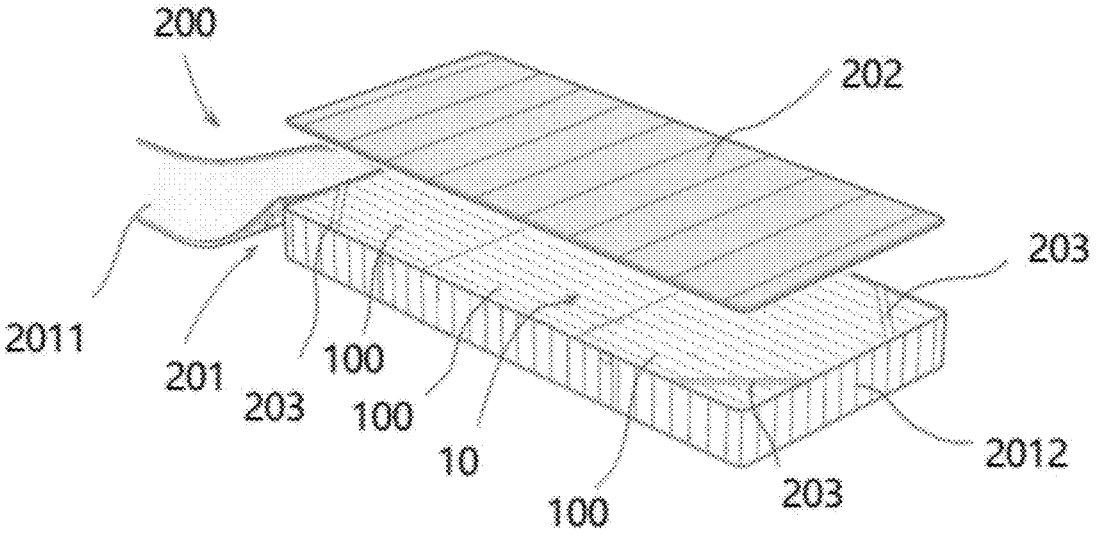
FIG. 1B shows a perspective and partially exploded view of the interior of the mattress of FIG. 1A.

Referring to FIGS. 1A and 1B, the mattress M to be packaged according to the packaging method of the present invention mainly includes a mattress core 10 and a cover material 200 covering/wrapped on the mattress core. Herein "cover material" means all the woven or nonwoven materials covering from above or below or surrounding the mattress core. The mattress core is assembled by multiple core blocks. The cover material 200 comprises a mattress cover 201 and a functional pad 202 to be laid on the mattress core, such as a comfort pad. As shown in FIG. 1B, the mattress cover 201 may comprise an upper covering part 2011 and a lower covering part 2012. The core blocks are placed in a box-shaped cavity defined by the lower covering part. The size of the well-assembled mattress is basically the same as the size of the mattress cover. The four corners of the mattress cover are also provided with elastic bands or strips 203 for restraining the movement of the core blocks in the box-shaped cavity. In order to provide better comfort, a comfort pad is placed on an upper side of the mattress core. The comfort pad can be placed directly on the mattress core and then covered by the upper covering part of the mattress cover. Preferably, four corners of the comfort pad are all fixed by means of elastic strips.

I. Assembling Pattern of Intended Mattress Core and Corresponding Rolling-Up Scheme For all types of mattresses on the market, mattress cores of corresponding sizes and appropriate assembling patterns can be designed according to the present invention. For the convenience of explanation and understanding, a concept of core segment is introduced to explain the rolling-up scheme.

First Embodiment

Figure 2A:
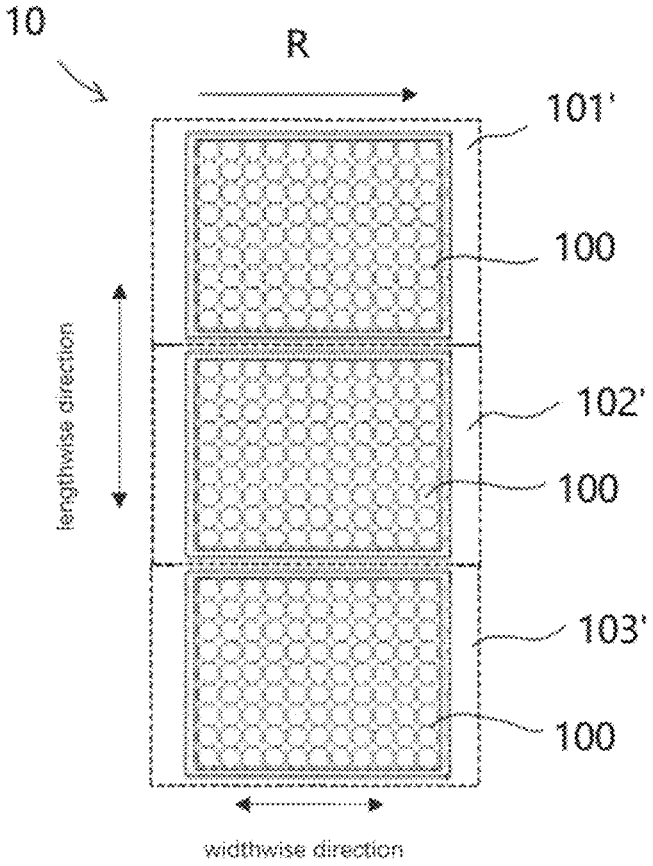
FIGS. 2A and 2B are diagrammatic illustrations of a mattress core for a single bed and three core rolls formed by rolling up the core segments.

FIG. 2A shows a side-by-side arrangement of three core segments 101', 102', 103' (as shown by the dotted bordered rectangles in FIG. 2A) intended for forming a single bed mattress core 10 having a dimension for example of approximately 180~203 cm length and 50~120 cm width.

Figure 2B:
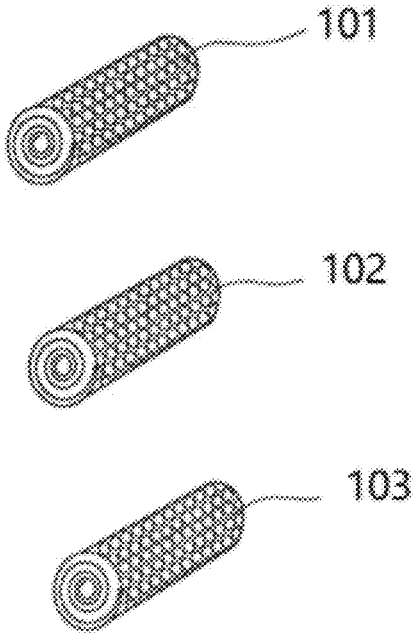

In each core segment, there is only one core subsegment 100. Among the core segments, core subsegments are in the same shape and size, i.e. having same length and width. Each core segment can be rolled along a rolling direction R into a core roll 101, 102, 103, as shown in FIG. 2B. And each core roll has a same length measured along its lengthwise direction (i.e. in the axial direction of the roll) and a same width measured at an unrolled state (i.e. unrolled width).

Once unrolled and laid flat, each core segment returns to its original size with a same length and a same width (i.e. unrolled width). These unrolled core segments can be assembled on site directly by the users themselves. All the assembling work can be completed, for example, under brief instructions or directions on a commodity brochure, to get a mattress core of a custom-made size, without the need of asking help from workers.

Although it is shown in FIG. 2A that the rolling direction R is coincident with the widthwise direction of the intended mattress, each core segment can be rolled along the lengthwise direction of the intended mattress. Similarly, three core rolls having a same length and a same diameter (or unrolled width) can also be obtained. Therefore, the rolling direction R can be determined according to the length and width of the specific mattress core segment, and the main consideration is whether the length of the roll formed meets the requirements of transportation or delivery.

Although in the embodiment shown there are three core segments aligned (or arranged in a row) in the lengthwise direction of the intended mattress core, it will be appreciated that two or more than three core segments can be aligned in the lengthwise direction of the intended mattress core, with each core segment sharing the same length and the same width.

Second Embodiment

Figure 3A:
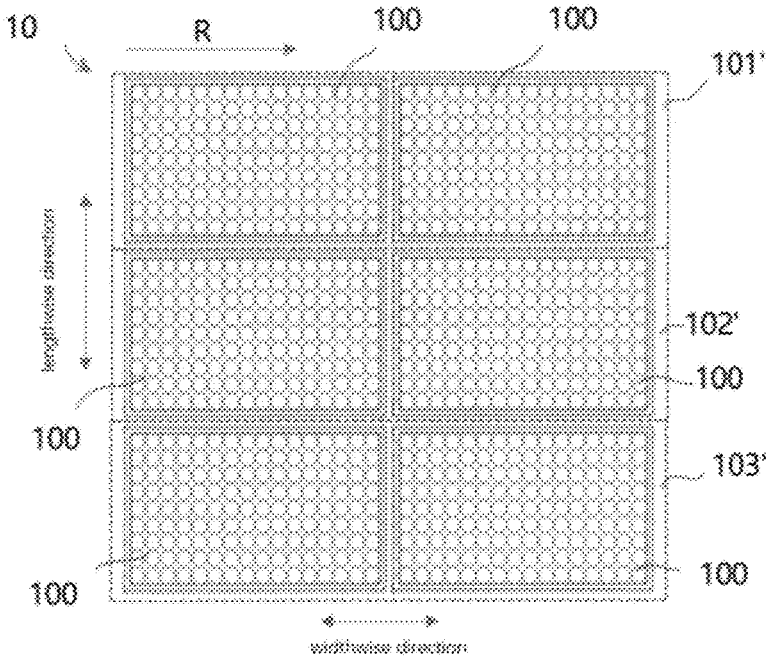
FIGS. 3A and 3B are diagrammatic illustrations of a mattress core for a double/king/queen bed and three core rolls formed by rolling up the core segments.

FIG. 3A shows a side-by-side arrangement of three core segments 101', 102', 103' intended for forming a double-bed mattress core having a dimension for example of approximately 180~203 cm length and 100~200 cm width. The mattress core 10 can be designed to have a dimension of, for example, 180 cm length and 180 cm width.

Figure 3B:
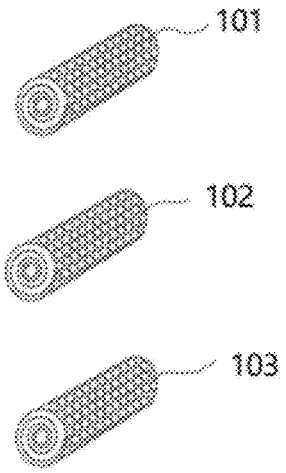

In each core segment, there are two core subsegments 100 in the same shape and size, i.e. having a same length and a same width of, for example 50~100 cm, preferably 60 cm or 90 cm. The two core subsegments are aligned in the widthwise direction of the intended mattress core. Each core segment can be rolled along a rolling direction R into a core roll 101, 102, 103, as shown in FIG. 3B. And each core roll thus obtained has a substantially same length measured along its lengthwise direction and a substantially same diameter measured in its cross section. Once unrolled and laid flat, each core segment returns to its original size with a substantially same length and a substantially same width (i.e. unrolled width).

Third Embodiment

Figure 4A:
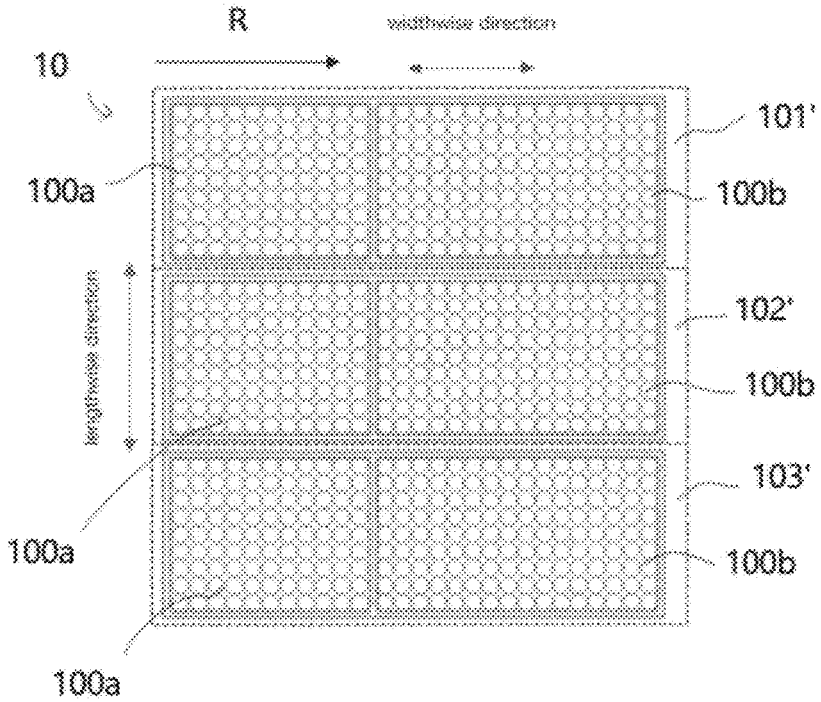
FIGS. 4A and 4B are diagrammatic illustrations of a mattress core for a double/king/queen bed and three core rolls formed by rolling up the core segments.

FIG. 4A shows a side-by-side arrangement of three core segments 101', 102', 103' intended for forming a double-bed mattress core having a dimension for example of approximately 180~203 cm length and 100~200 cm width. The mattress core 10 can be designed as having a dimension of, for example, 180 cm length and 150 cm width.

Different from the second embodiment, the core subsegments in each core segment of this third embodiment are the same in length, but are different in width. The length and width of the mattress core subsegment are measured according to the lengthwise direction and widthwise direction of the mattress core respectively, regardless of whether it meets the condition that the length is greater than or equal to the width. For example, the first core subsegment 100*a* has a width of 60 cm and a length of 65 cm, and the second core subsegment 100*b* has a width of 90 cm and a length of 65 cm. Hence, the sum of the widths of the first core subsegment and the second core subsegment is substantially equal to 150 cm which is a typical width of a mattress for a double bed.

Figure 4B:
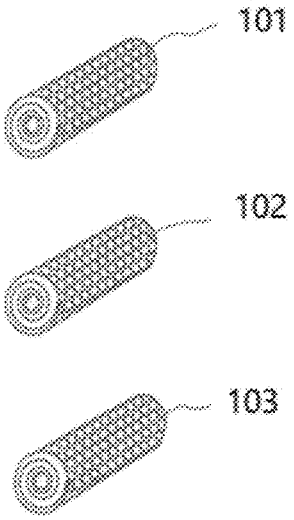

Each core segment comprising the first and second core subsegments aligned in the widthwise direction of the intended mattress core can then be rolled along a rolling direction R into a core roll 101, 102, 103, as shown in FIG. 4B. And each core roll thus obtained has a same length measured along its lengthwise direction and a same diameter measured in its cross section. Once unrolled and laid flat, each core segment returns to its original size with a substantially same length and a substantially same width (i.e. unrolled width).

Fourth Embodiment

Figure 5A:
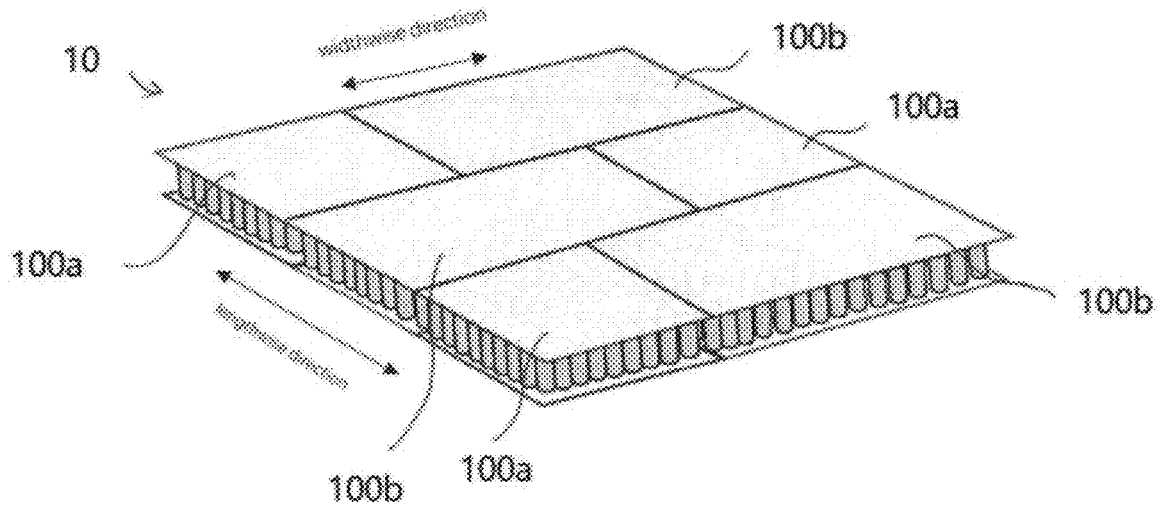
FIG. 5A shows a perspective view of mattress core for a double/king/queen bed, with core subsegments being arranged in different sequences among core segments.

FIG. 5A shows an arrangement of three core segments 101', 102', 103' (as shown by the dotted bordered rectangles in FIG. 5B) intended for forming a double-bed mattress core 10 having a dimension for example of approximately 180~203 cm length and 100~200 cm width.

Figure 5B:
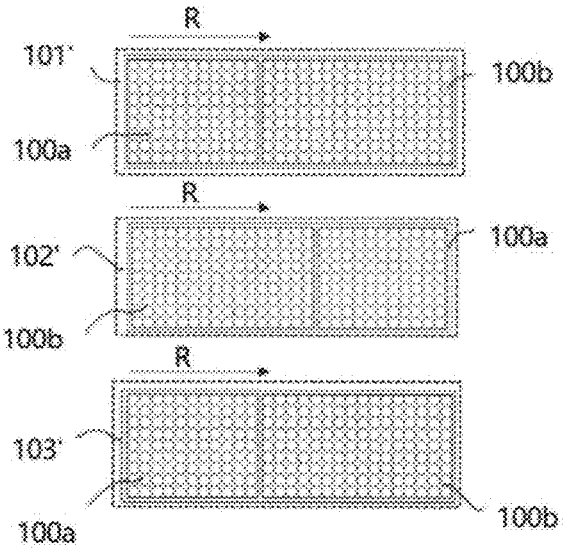
FIGS. 5B, 5C and 5D show the core segments of the mattress core of FIG. 5A before rolling, in the process of rolling and after rolling up into a generally cylindrical form respectively.

Different from the third embodiment, among core segments, the first and second core subsegments are arranged in different sequences (along the widthwise direction, as shown in FIG. 5B). As shown in FIGS. 5A and 5B, the core subsegments in the core segment corresponding to a middle section of the intended mattress core are arranged in a sequence different from those in the core segments corresponding to end sections of the intended mattress core.

Figure 5C:
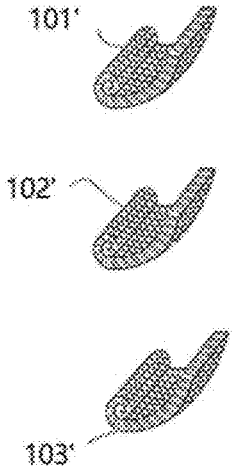
Figure 5D:
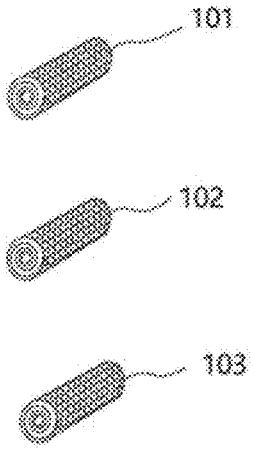

Accordingly, each core segment is rolled up into a core roll 101, 102, 103 along the rolling direction R, as shown in FIGS. 5B, 5C and 5D. From especially FIG. 5B, it can be seen that, among core rolls, the core subsegments 100*a*, 100*b* are arranged in different sequences also. In the embodiment shown, in the core roll corresponding to the middle section of the intended mattress core, the second core subsegment 100*b* is located in the innermost area of the core roll and the first core subsegment 100*a* is in the outermost area of the core roll. While core rolls corresponding to the end sections of the intended mattress core have the first core subsegments 100*a* in the innermost area and the second core subsegments 100*b* in the outermost area.

However, when viewed from the outside, these core rolls are substantial the same, sharing a same length and a same diameter measured in its cross section. Once unrolled and laid flat, each core segment returns to its original size with a same length and a same width (i.e. unrolled width).

Fifth Embodiment

FIG. 6A is a diagrammatic illustration of a mattress core 10 to be assembled by three identical core segments 101', 102', 103' each of which has three core subsegments 100 aligned in the widthwise direction of the intended mattress core. Thus, different from the second embodiment, each core segment has more than two core subsegments. In the embodiment shown, core subsegments in each core segment are identical to each other in shape and size, for example, having a dimension of 60~65 cm length and 50~65 cm, preferably, 60 cm width. It will be appreciated that core subsegments in each core segment can be different in size.

As shown in FIG. 6B, each core segment can be rolled along the rolling direction R into a core roll 101, 102, 103. And the core rolls obtained each have a substantially same length measured along its lengthwise direction and a substantially same diameter measured in its cross section.

Figure 7A:
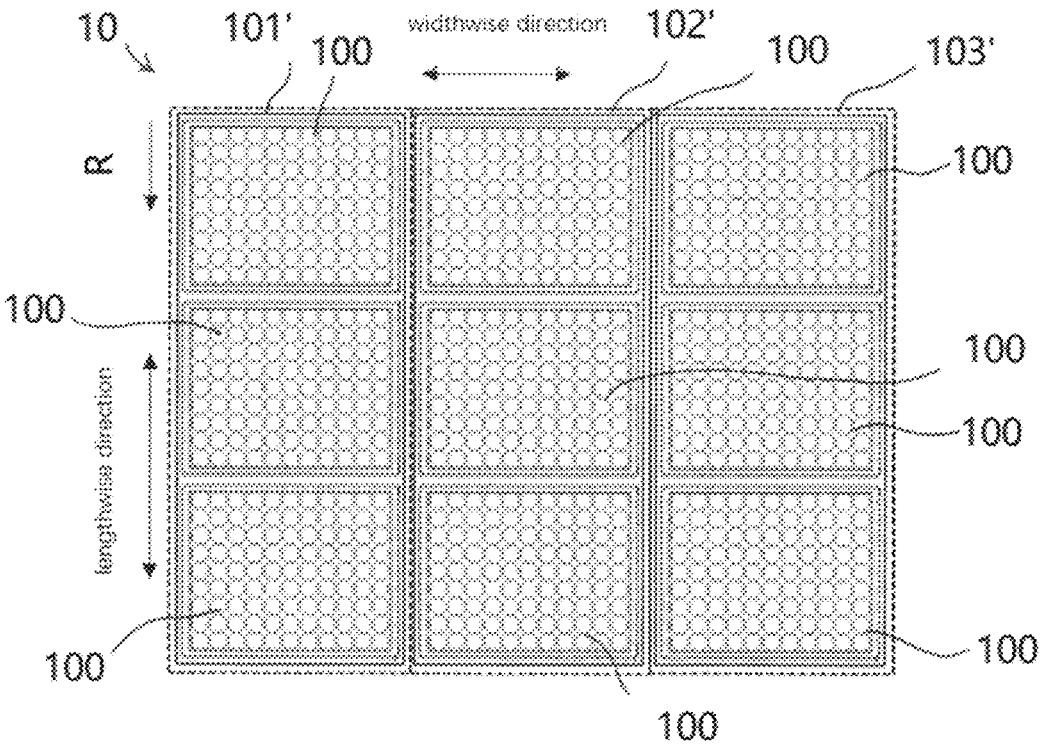
FIGS. 7A and 7B are diagrammatic illustrations showing another assembling pattern for the mattress core of FIG. 6A, and three core rolls formed by rolling up core segments along the lengthwise direction of the mattress core.
Figure 7B:
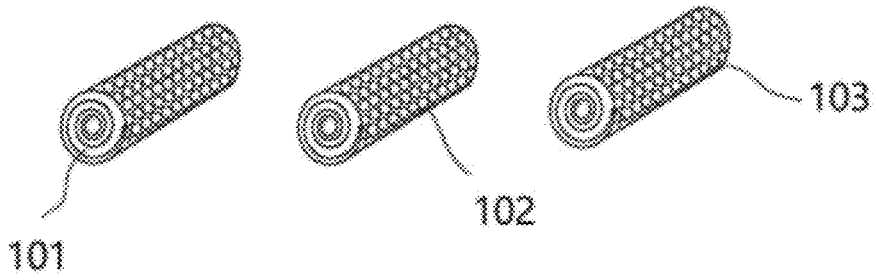

FIG. 7A shows a mattress core of the same size as that of FIG. 6A, comprising a 3×3 array of the core subsegments in the same size, for example, with 60~65 cm length and 50~65 cm, preferably, 60 cm width. The difference between the mattress cores of FIG. 7A and FIG. 6A lies in that their core segments 101', 102', 103' extend in different directions, and also their rolling directions are different from each other. As shown in FIG. 7B, the length of each core roll is about one third of the width of the intended mattress core and the unrolled width of each core roll is substantially the same as the length of the intended mattress core.

Rolling Based on Modularization of Mattress Core

From the description of all the above embodiments, it can be seen that, the sum of the length of multiple core rolls 101, 102 and 103 corresponds to the length or width of the mattress core 10. Therefore, the modularization of the mattress core and the rolling of the core segments allow the packaging size of the core roll to be reduced in such a flexible way that almost mattress core of any size can be easily packaged for transportation.

Although it is shown in the above embodiments that three core rolls are formed for each mattress core. However, for those skilled in the art, the specific number of core rolls can be different according to the specific size of the mattress core. The size of the core subsegments 100 in each core segment can be same or different to each other.

Herein, "basically the same" and "the same" both mean the two under comparison are basically the same or identical with or without differences falling within a permissible error range, and without taking into account shape and/or size differences caused by the connection structures between the core subsegments or the connection structures between the core segments.

The core subsegments intended for a mattress core of any conventional size can be selected from the base module(s) with a predefined length and a predefined width. The predefined width of the base module can be selected from 50-100 cm, preferably 60 cm or 90 cm. The predefined length of the base module can be selected from 50-100 cm, preferably 65 cm.

Taking the second embodiment for an example (as shown in FIG. 3A), six base modules having a dimension of 65 cm length and 60 cm width are selected as core subsegments to make up a 195 cm×120 cm mattress core. While, once base modules, each of which has 65 cm (length)×90 cm (width), are selected, a mattress core of 195 cm×180 cm can be made up.

Similarly, the mattress core of the third embodiment can be made up by choosing three pieces of a first base module in 65 cm×60 cm size as the first core segments 100*a* and three pieces of a second base module in 65 cm×90 cm size as the second core segments 100*b* and putting them together in the pattern according to the third embodiment as shown in FIG. 4A.

For reducing the movement between the core subsegments (base modules), as shown in the fourth embodiment (FIG. 5A), the core subsegments are arranged in a same or different sequence among core segments. Also, this staggered arrangement of the core subsegments makes it possible to provide diversities in for example, softness, so as to meet different needs of the customers. This is widely applied for a couple bed. Of course, since now the mattress core is made up based on modules, users can easily change or move the modules to adapt to their specific needs, without involving much effort in the reorganization of the entire mattress core.

The number of specific base modules in each core segment can be designed according to the size of selected base module and the size of the intended mattress core. Preferably, a core segment comprises at most three base modules, thereby avoiding dividing a mattress core into too many modules in an inefficient manner.

For a special mattress core whose size is different from that for a conventional single bed or double bed, some of the core subsegments can be selected from the base modules, and the rest of the core subsegments with special size can be customized on demand.

II. Applicable Material Types of Core Segment/Core Subsegment

As mentioned above, a mattress core is basically composed of multiple core subsegments. The material of the core subsegments can be the same or different. For example, the core subsegments or the core segment composed of core subsegments can be pieces in the form of a spring core, such as a pocket-spring core, or a latex core or a sponge core (such as a foam mattress core), etc.

The existing spring mattress core is mainly composed of one-piece monolithic mattress core block, which is not only big but also bulky. But the spring mattress, especially the pocket-spring mattress which has a plurality of interconnected encased helical springs coupled together usually in regular array to form specific geometric dimensions (each helical spring being arranged in a closed pocket made of fabric, nonwoven or the like), is welcomed by the majority of users, because it can provide lasting elasticity.

The packaging method based on modularization according to the present invention has obvious advantages in terms of convince in packaging and cost in transportation, especially for the spring mattress core (or rather, the pocket-spring mattress core).

III. Method for Packaging a Mattress

Hereinbelow, a packaging method for a mattress according to the present invention will be described with reference to FIGS. 2A to 9.

a) Compression Operation

In order to facilitate packaging and reduce the package size, it is preferable that the mattress core segments are compressed prior to rolling.

Before compressing, each core segment is put within a plastic bag or envelope with one open end through which air can be removed from within the bag before the open end is sealed.

Each core segment is compressed into a flattened form with reduced thickness in the plastic bag or envelope. During compression, air is removed from within the bag, and then the bag is sealed by hot sealing. In the flattened condition of the core segment, the springs therein are compressed to at least near their minimum height. Compression of the core segment to the flattened form may involve reduction of height by an order of magnitude or more, for example from more than ten centimeters (for example, 20 centimeters) down to one or two centimeters or so.

b) Rolling Operation

The method of packing the mattress according to the present invention comprises the step of rolling the flattened core segment into a rolled, generally cylindrical form. At the end of rolling, an additional external wrapping of the plastic film around the coiled core segment can be provided by several more turns. The coiled core segment and the covering plastic film can then be secured using adhesive tape, string, strapping or the like.

In addition to the step of rolling the core segments, the method of packaging a mattress according to the present invention further comprises a step of rolling up the cover material.

As shown in FIGS. 1A and 1B, the mattress core is covered with a cover material 200. These cover materials are wrapped on the outside of the mattress core 10, which can protect the mattress core on the one hand and provide room for improvement in comfort of the mattress on the other hand.

Figure 8A:
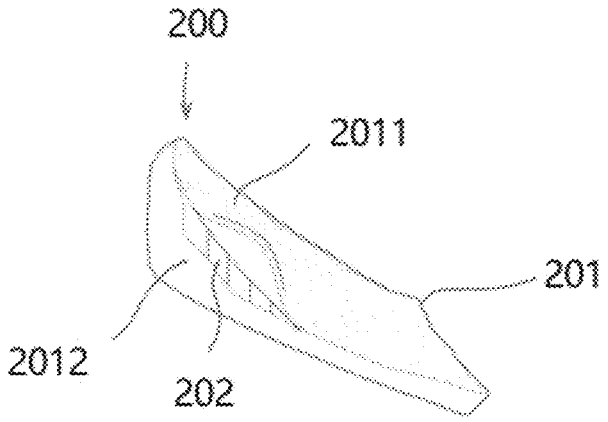
FIG. 8A is a perspective view illustrating a mattress cover with a functional pad laid flat inside.

As shown in FIG. 8A, the cover material 200 comprises a mattress cover 201 which is substantially in the form of a bag and a functional mattress 202 whose size matches the mattress cover and/or the mattress core. For simplifying the packaging process, the function pad can be laid flat in the mattress cover.

Figure 8B:
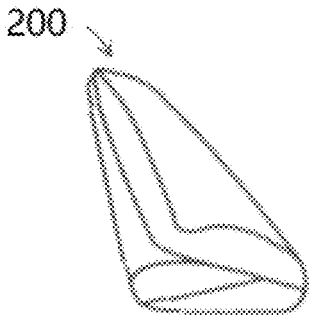
FIG. 8B shows a schematic view of a mattress cover in a fully folded state.
Figure 8C:
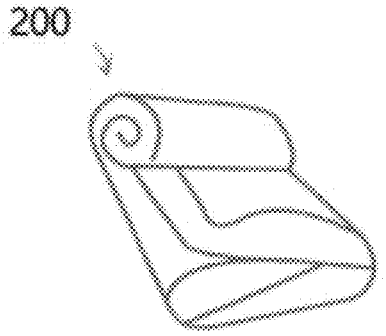
FIGS. 8C and 8D are perspective views of a folded mattress cover in a state where it is in the process of rolling and a state where it is rolled into a generally cylindrical form respectively.
Figure 8D:
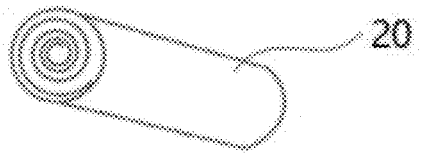

After the mattress cover is closed, the general shape and size are consistent with the matching mattress core. Referring to the embodiment shown in FIG. 1B, the mattress core is assembled by three core segments along the lengthwise direction. The corresponding upper covering part 2011 of the mattress cover is facing upward, and two imaginary folding lines extending in the widthwise direction are selected at one third and two thirds of the length of the mattress cover. Along the first folding line, one-third portion on a first end of the mattress cover is folded onto the rest part of the mattress cover, and then another one-third portion on a second end of the mattress cover is folded onto the top along the second folding line. The shape and size of the folded mattress cover are basically consistent with the shape and size of the core segment of the matched mattress core, as shown in FIG. 8B. Next, the folded mattress cover is rolled in the same direction as the rolling direction of the core segment, as shown in FIG. 8C. At the end of rolling, it is fixed by wrapping a plastic film. Therefore, a covering roll 20 as shown in FIG. 8D is obtained.

c) boxing operation

The core rolls and covering rolls obtained are then placed in a box 30, for example, cardboard box (preferably a corrugated fiberboard box) in a suitable size. A corrugated fiberboard box is a commonly used packing that is of low economic cost and strong enough to withstand the collision and extrusion in the whole process of transportation, and can therefore be used to protect the core rolls in the box from any damage.

Figure 9:
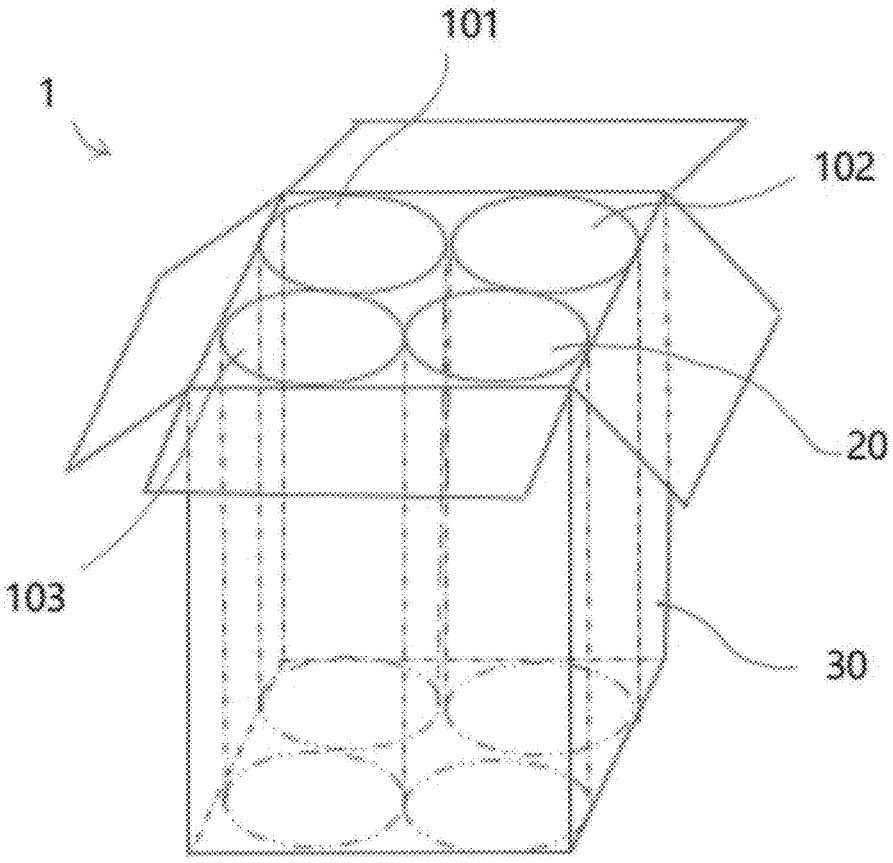
FIG. 9 is a schematic view of a mattress package according to one embodiment of the present invention.

Referring to mattress package 1 shown in FIG. 9, three core rolls 101, 102 and 103 for forming an entire mattress core and a covering roll 20 for covering the mattress core are placed in the packaging box 30. The axes of the core rolls and the covering roll are basically parallel to each other.

Because the cover material is folded into the same shape and size as the core segment before rolling, and the rolling direction is the same as that of the core segment, the covering roll thus obtained and core rolls have basically the same length. In this way, when the core rolls and the covering roll are placed in the packaging box in parallel, the upper ends of these rolls are basically flush and roughly consistent with the height of the packaging box. Therefore, a higher packing rate can be obtained. In addition, in the embodiment shown, since there are four rolls each of which occupies about one quarter of the cross-sectional area of the packaging box, the packaging box can get into a balanced/stable state where local weak parts of the packaging box caused due to uneven force can be avoided from occurring.

In the process of transportation, the mattress packages need to be stacked and transported to a designated location in the warehouse by an automated guided vehicle. In the process of stacking, according to the maximum allowable height of stacking, the packages can be placed either in a horizontal position or in a vertical position. No matter in what position they are placed, the core rolls and covering roll therein can be well protected without collapse or deformation.

Using the packaging method according to the present invention, a pocket-spring mattress of a typical thickness, for example 21 cm, may be packed into a packaging box having approximate dimensions 70 cm×47 cm×47 cm.

It will of course be appreciated that mattresses of different dimensions may result in different package sizes and therefore packages or parcels that can be transported with lower cost, as will be apparent from the foregoing description.

Following transport of the mattress package to its location for intended use, the covering roll 20 is taken out from the box, unfolded and laid on the predetermined position. The mattress cover 201 is opened and then the functional pad 202 inside is taken out.

The core segments can be deployed by taking out the core rolls 101, 102, 103 from the box, cutting off the tape and/or plastic film, unfolding the core rolls and piercing the bag to allow air to enter and depressurize the core segments. The natural resilience of the springs will then cause the core segments to return to its original form by unrolling with little or no assistance from the user.

The core segments are assembled according to the installation method described in the product manual. For example, a mark of installation orientation is printed on each core segment. According to the mark, users can determine which side of the related core segment corresponds to the length or width direction of the intended mattress. The assembling operation of the core segments can be directly carried out in the cavity defined by the lower covering part 2012 of the mattress cover 201. The elastic strips 203 at the four corners of the mattress cover can help to restrain the core segments 100 and prevent them from moving.

Figure 10:
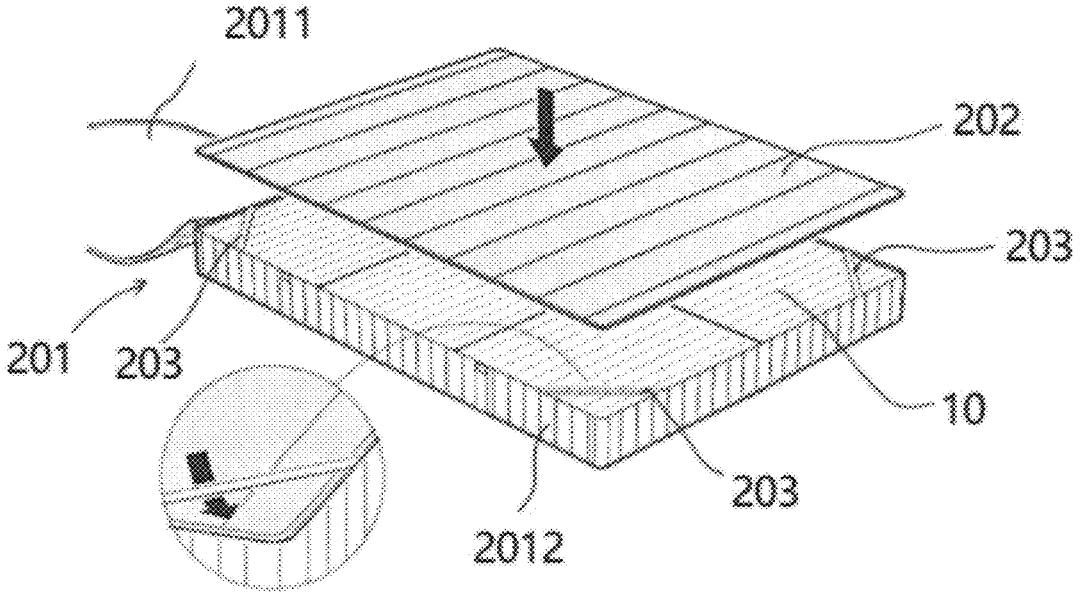
FIG. 10 diagrammatically illustrates how to put the functional pad on the well-assembled mattress core.
Figure 11:
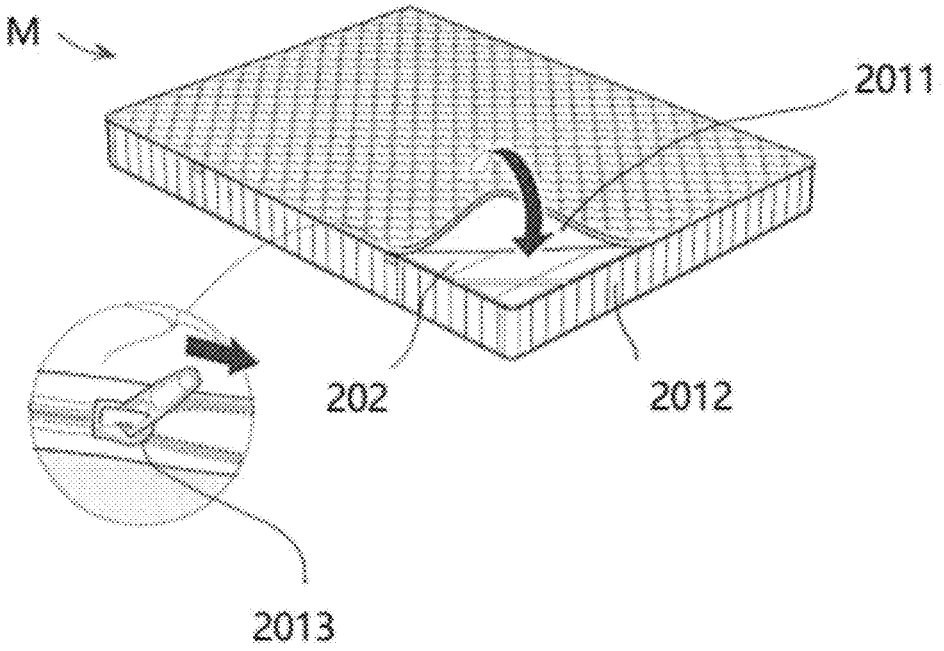
FIG. 11 diagrammatically illustrates the closing of the zipper of the mattress cover to put the mattress in a position ready for use.

Next, as shown in FIG. 10, the functional pad 202 is laid on the well-assembled mattress core 10. The four corners of the functional pad are secured under the elastic strips 203, thereby fixing the functional pad on the mattress core with the help of the elastic strips.

The upper covering part 2011 of the mattress cover is laid flat on the mattress core, and the mattress cover is closed by a zipper 2013 or other means. Thus, a finished mattress is formed and ready for use.

The method according to the present invention allows to pack a mattress in a box of a size that is manageable for transportation. The packaged configuration enables a purchaser to transport the mattress home from the retail establishment themselves, and permits convenient delivery by commercial transportation agencies. This in turn increases opportunities for users to purchase the mattress product online and have it delivered.

While aspects of the present invention have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is to be claimed:

1. A mattress package, comprising:

a plurality of core rolls defined by a plurality of rolled up core segments;

a covering roll defined by a rolled up cover material configured to cover a mattress core formed via assembling the plurality of core segments; and a box containing the plurality of core rolls and the covering roll.

2. The mattress package according to claim 1, wherein;

the plurality of core rolls and the covering roll are arrangeable in parallel in the box; and the plurality of core rolls are substantially the same in length.

3. The mattress package according to claim 1, wherein:

the plurality of core rolls each have a length; and a sum of the lengths of the plurality of core rolls is equal to at least one of a length of the mattress core and a width of the mattress core.

4. The mattress package according to claim 1, wherein a length of the covering roll is substantially the same as a length of each core roll of the plurality of core rolls.

5. The mattress package according to claim 1, wherein the plurality of core rolls includes from two to six core rolls.

6. The mattress package according to claim 1, wherein the box is a cardboard box.

7. The mattress package according to claim 1, wherein each core segment of the plurality of core segments includes a plurality of core subsegments arranged in a row along an unrolling direction of the respective core segment.

8. The mattress package according to claim 7, wherein the plurality of core subsegments are pieces in the form of spring cores.

9. The mattress package according to claim 7, wherein the plurality of core subsegments are one of (i) the same in size and (ii) different in size.

10. The mattress package according to claim 9, wherein:

each core subsegment of the plurality of core subsegments is selected from a first base module and a second base module;

the first base module and the second base modules are the same in length but different in width ranging from 50 cm to 100 cm; and at least one of:

the plurality of core segments each include three base modules or less;

the plurality of core segments each include one first base module and one second base module;

the base modules of a core segment of the plurality of core segments are arranged in one of (i) a same sequence and (ii) a different sequence as the base modules of at least one other core segment of the plurality of core segments; and the plurality of core segments includes a middle core segment, a first end core segment, and a second end core segment that define a middle section, a first end section, and a second end section of the mattress core, respectively, the base modules of the middle core segment arranged in a sequence different from the base modules of the first end core segment and the base modules of the second end core segment.

11. The mattress package according to claim 1, wherein the cover material includes:

a mattress cover for wrapping around the mattress core; and a functional pad for covering the mattress core.

12. The mattress package according to claim 11, wherein the mattress cover includes a plurality of elastic strips for holding the mattress core at a plurality of corners of the mattress core.

13. A method for packaging a mattress, the mattress including (i) a plurality of core segments arranged side-by-side in one of a lengthwise direction and a widthwise direction of the mattress and (ii) a cover material provided for covering a mattress core formed via assembling the plurality of core segments, the method comprising:

rolling up the plurality of core segments respectively along the other-direction of the lengthwise direction and the widthwise directions to form a plurality of core rolls;

folding and rolling up the cover material into a covering roll; and putting the plurality of core rolls and the covering roll into a box.

14. The method according to claim 13, wherein the plurality of core rolls includes from two to six core rolls.

15. The method according to claim 14, wherein the plurality of core segments includes a plurality of spring core segments.

16. The method according to claim 13, further comprising compressing each core segment of the plurality of core segments in a thickness direction of the respective core segment before rolling up the respective core segment.

17. The method according to claim 16, wherein;

the plurality of core segments each include a plurality of core subsegments; and the method further comprises, before compressing a respective core segment of the plurality of core segments, packing the plurality of core subsegments of the respective core segment into a bag with the plurality of core subsegments arranged in a row along a rolling direction of the respective core segments.

18. The method according to claim 17, wherein:

each core subsegment of the plurality of core subsegments is selected from a first base module and a second base module;

the first base module and the second base modules are the same in length but different in width ranging from 50 cm to 100 cm; and at least one of:

the plurality of core segments each include three base modules or less;

the plurality of core segments each include one first base module and one second base module;

the method further comprises arranging the base modules of a core segment of the plurality of core segments in one of (i) a same sequence and (ii) a different sequence as the base modules of at least one other core segment of the plurality of core segments; and the method further comprises arranging the base modules of a middle core segment of the plurality of core segments in a sequence different from the base modules of a first end core segment of the plurality of core segments and the base modules of a second end core segment of the plurality of core segments, and the middle core segment, the first end core segment, and the second end core segment define a middle section, a first end section, and a second end section of the mattress core, respectively.

19. The method according to claim 13, wherein folding and rolling up the cover material includes folding the cover material into a substantially same size and shape as one core segment of the plurality of core segments and then rolling up the folded cover material along a same direction as the plurality of core segments.

20. The method according to claim 13, wherein the box is a cardboard box.

* * * * *